US011560656B2

(12) United States Patent
Kajiwara et al.

(10) Patent No.: US 11,560,656 B2
(45) Date of Patent: Jan. 24, 2023

(54) ELASTICALLY DEFORMABLE BRAIDED STRING

(71) Applicant: TWINS CORPORATION, Funabashi (JP)

(72) Inventors: Ryuji Kajiwara, Funabashi (JP); Takashi Tsuchida, Funabashi (JP)

(73) Assignee: TWINS CORPORATION, Funabashi (JP)

( * ) Notice: Subject to any disclaimer, the term of this patent is extended or adjusted under 35 U.S.C. 154(b) by 95 days.

(21) Appl. No.: 17/057,610

(22) PCT Filed: Oct. 31, 2018

(86) PCT No.: PCT/JP2018/040480
§ 371 (c)(1),
(2) Date: Nov. 20, 2020

(87) PCT Pub. No.: WO2019/230016
PCT Pub. Date: Dec. 5, 2019

(65) Prior Publication Data

US 2021/0189617 A1 Jun. 24, 2021

(30) Foreign Application Priority Data

May 31, 2018 (JP) ..... JP2018-104865

(51) Int. Cl.
*D04C 1/12* (2006.01)
*D04C 1/02* (2006.01)

(52) U.S. Cl.
CPC ..... *D04C 1/12* (2013.01); *D04C 1/02* (2013.01)

(58) Field of Classification Search
CPC ..... D04C 1/02; D04C 1/12; D07B 2201/102; D07B 2201/1096
See application file for complete search history.

(56) References Cited

U.S. PATENT DOCUMENTS 1,533,964 A * 4/1925 Meyer ..... A43C 1/02 24/715.3
2,869,205 A 1/1959 Raimund
(Continued)

FOREIGN PATENT DOCUMENTS

DE 3129857 A1 2/1983
EP 1795085 A1 6/2007
(Continued)

OTHER PUBLICATIONS

Extended European Search Report (EESR) dated Feb. 9, 2022, issued for European counterpart patent application No. EP18920845.7 (9 pages).
(Continued)

*Primary Examiner* — Shaun R Hurley
(74) *Attorney, Agent, or Firm* — Law Office of Katsuhiro Arai

(57) ABSTRACT

An elastically deformable braided string whose intermediate part excluding both end areas can deform elastically in the direction of axis under an external pulling force, wherein the intermediate part is divided into/constituted by multiple areas having different tensile moduli in the direction of axis. The above elastically deformable braided string can be applied for various purposes.

19 Claims, 6 Drawing Sheets

(56) References Cited

U.S. PATENT DOCUMENTS 3,110,945 A * 11/1963 Howe, Jr. ..... A43C 9/00 24/713
4,694,541 A * 9/1987 Skyba ..... F16G 11/12 24/301
5,272,796 A * 12/1993 Nichols ..... D04C 1/12 24/712
5,673,546 A * 10/1997 Abraham ..... A43C 9/00 87/3
6,513,210 B1 2/2003 Gonzalez
7,549,201 B2 * 6/2009 Kraft ..... A43C 9/00 24/713
D606,296 S * 12/2009 Mouton ..... D2/978
7,763,011 B2 * 7/2010 Ortiz ..... A61F 2/90 604/509
8,409,269 B2 * 4/2013 Berez ..... A61F 2/90 623/1.11
8,960,065 B2 * 2/2015 Masson ..... D04C 1/06 87/41
9,314,324 B2 * 4/2016 Janardhan ..... A61B 17/22032
9,675,137 B2 * 6/2017 Wu ..... A43C 9/00
2005/0283220 A1 12/2005 Gobran et al.
2012/0232655 A1 * 9/2012 Lorrison ..... D03D 3/02 28/151
2013/0205553 A1 * 8/2013 Lin ..... A43C 9/00 24/712
2013/0255045 A1 10/2013 Gonzalez
2014/0007392 A1 * 1/2014 Kajiwara ..... A43C 1/003 24/715.3
2017/0065026 A1 3/2017 Wu

FOREIGN PATENT DOCUMENTS

FR 590459 A 6/1925
JP 3493002 B2 2/2004
JP 5079926 B1 11/2012
JP 5392519 B1 1/2014
JP 2017048491 A 3/2017

OTHER PUBLICATIONS

International Search Report (ISR) dated Feb. 5, 2019, issued for International application No. PCT/JP2018/040480. (1 page).

* cited by examiner

[FIG. 1]
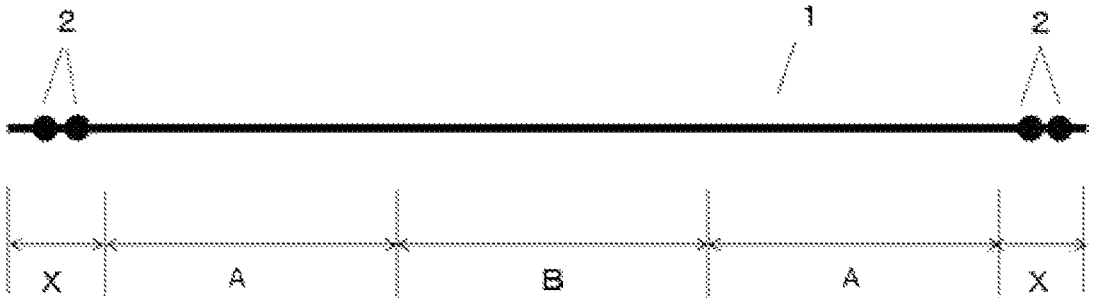
[FIG.2]
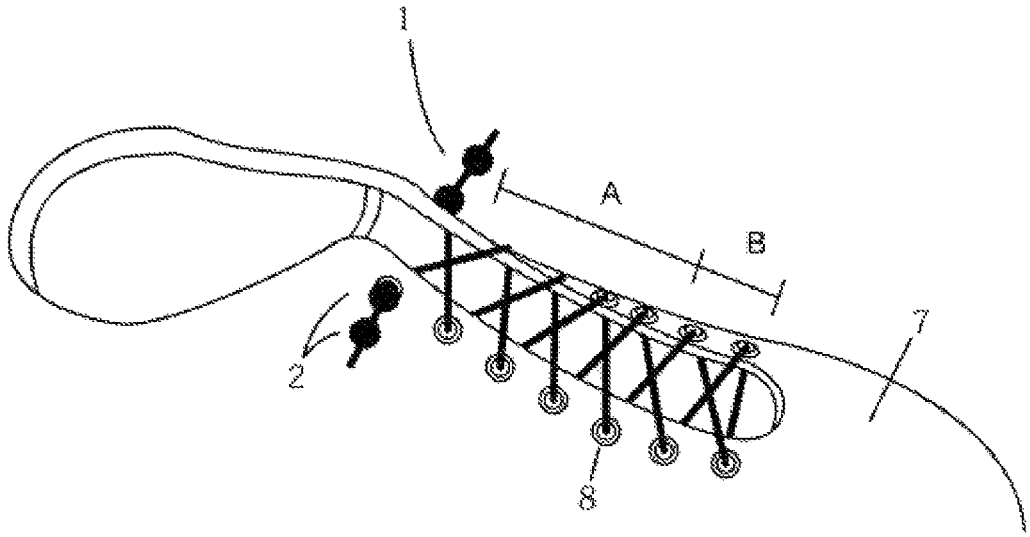

[FIG. 3]
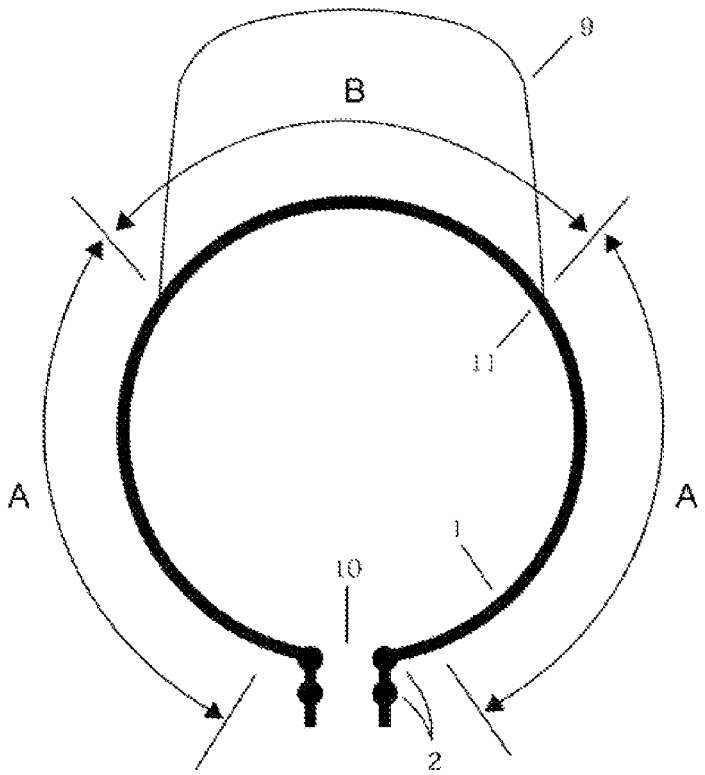
[FIG. 4]
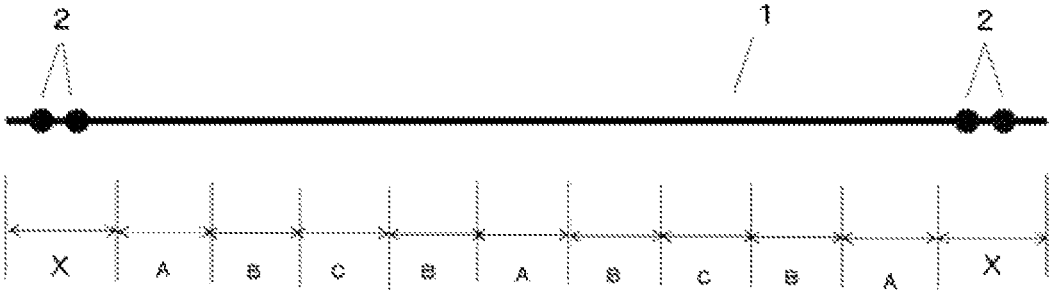

[FIG. 5]
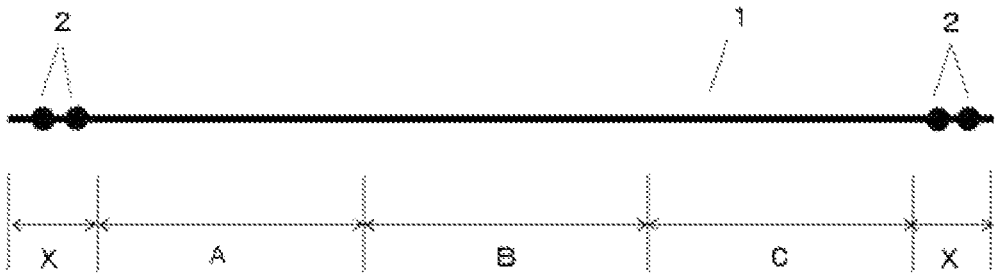
[FIG. 6]
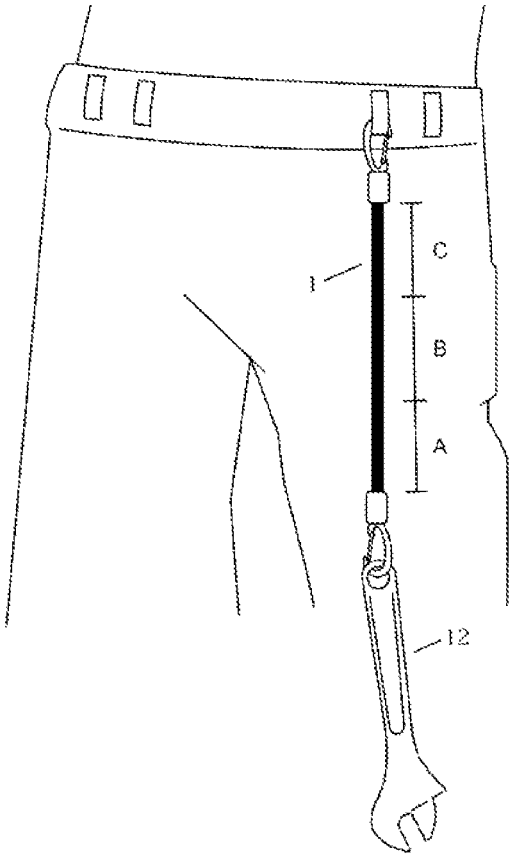

[FIG. 7]
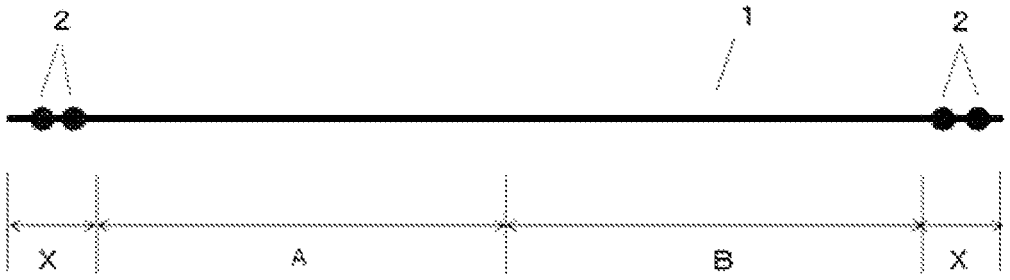
[FIG. 8]
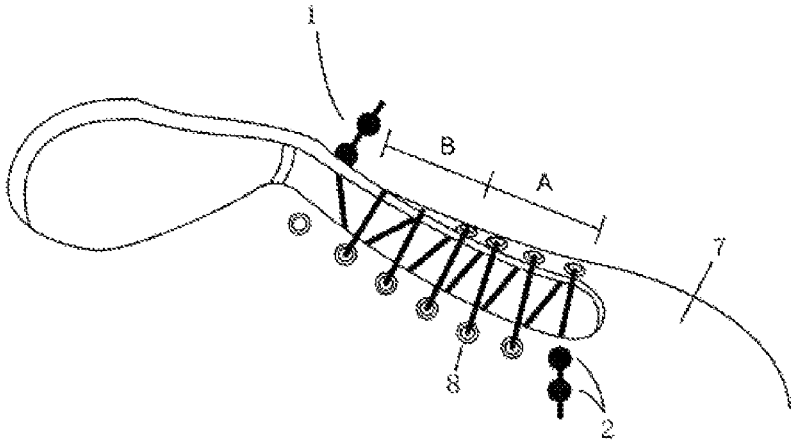
[FIG. 9]
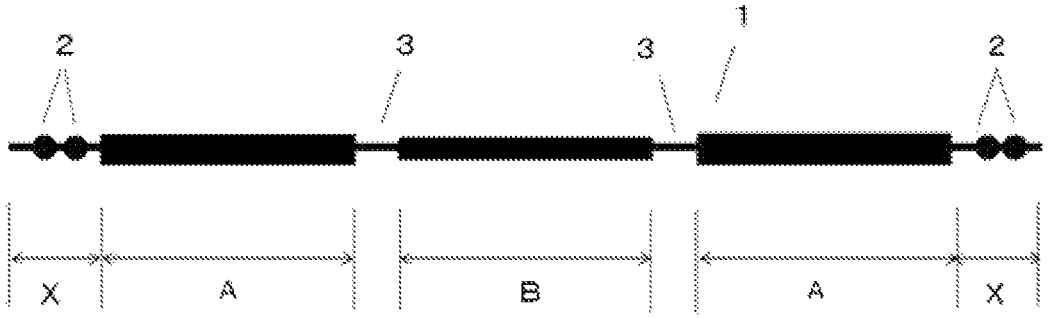

[FIG. 10]
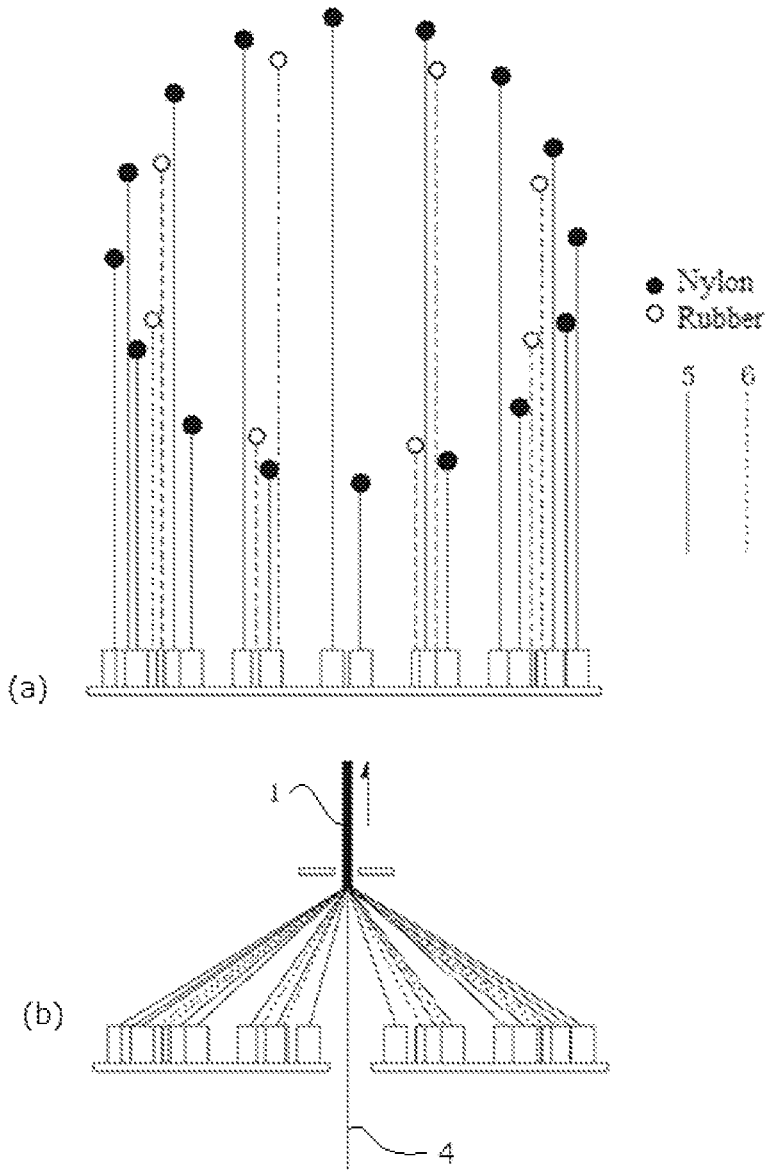

[FIG. 11]
Background Art
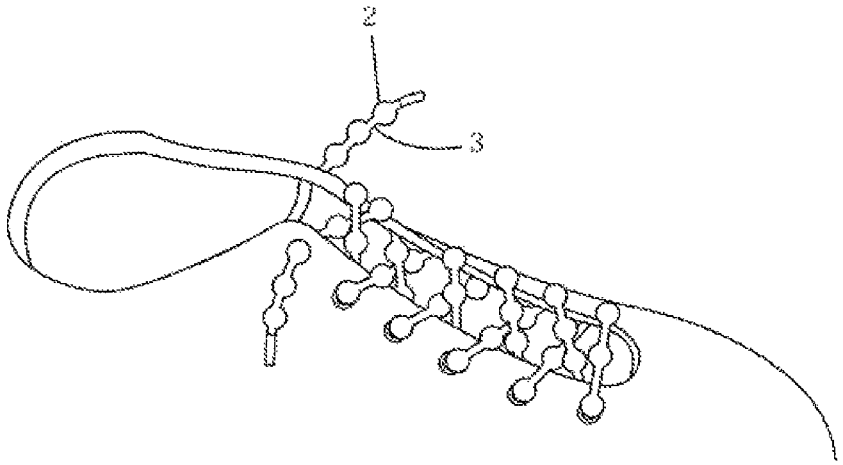

ELASTICALLY DEFORMABLE BRAIDED STRING

CROSS-REFERENCE TO RELATED APPLICATIONS

This application is the U.S. National Phase under 35 U.S.C. § 371 of International Application PCT/JP2018/040480, filed Oct. 31, 2018, which claims priority to Japanese Patent Application No. JP2018-104865, filed May 31, 2018. The International Application was published under PCT Article 21(2) in a language other than English.

TECHNICAL FIELD

The present invention relates to a braided string elastically deformable in the direction of axis.

BACKGROUND ART

Among the braided strings elastically deformable in the direction of axis, shoelaces, etc., that do not require knots have long been known. These traditional braided strings each comprise knob parts that can deform elastically in the direction of axis when a pulling force is applied, and link parts that link the knob parts together.

The traditional braided strings described in Patent Literatures 1 to 3 below have many elastically deforming knob parts placed at appropriate intervals in the direction of axis, wherein the knob parts are inserted in the string holes formed in the target on which the braided string is to be set and, as the user adjusts the positions of knob parts as he/she sees fit, the string is maintained in a set state held by pressure.

FIG. 11 is a perspective view showing a traditional braided string with knob parts, being applied as a shoelace. When used as a shoelace, the braided string is inserted through the string holes formed in a shoe, and set. When the string is in a natural state where no pulling force is applied, the knob parts maintain a diameter larger than the diameter of the string holes; as the string is pulled strongly, the knob parts deform elastically and pass through the string holes; then, once the knob parts have passed through the string holes and the pulling force is released, the knob parts restore themselves to their natural state and are held against the string holes, thus keeping the string tight without getting loose. When putting on or taking off the shoe, the knob parts deform elastically to allow the entire opening of the shoe to increase/change in size, which eliminates the need to tie or loosen the string every time. It should be noted that the link parts undergo virtually no elastic deformation, just like standard shoelaces.

BACKGROUND ART LITERATURE

Patent Literature

Patent Literature 1: Japanese Patent No. 3493002
Patent Literature 2: Japanese Patent No. 5079926
Patent Literature 3: Japanese Patent No. 5392519

SUMMARY OF THE INVENTION

Problems to be Solved by the Invention

The traditional braided strings that can deform elastically in the direction of axis are designed so that, as described above, many knob parts are placed over the entire length of the braided string, and as they are inserted in the string holes and their positions adjusted, the string is maintained in a set state held by pressure; however, this design presents problems in that the initial string setting is tedious and that, once the string is set, changing its pressure-held state is cumbersome because all knob parts must be released from the string holes and then inserted again. Also, because the tensile modulus is roughly the same with all knob parts, the tension cannot be changed at a given setting location. Furthermore, when such braided string is used as a shoelace, many knob parts appear on the shoe, as shown in FIG. 11, which is perceived as unsightly by some users.

An object of the present invention is to solve the problems of the prior art involving many knob parts placed in the direction of axis, and provide a new braided string whose intermediate part deforms elastically in various ways, instead of a braided string that deforms elastically due to its knob parts having the same tensile modulus.

Means for Solving the Problems

To achieve the aforementioned object, the invention under the present application for patent is an elastically deformable braided string whose intermediate part excluding both the left and right end areas can deform elastically in the direction of axis under an external pulling force, characterized in that the intermediate part is divided into/constituted by multiple areas having different tensile moduli in the direction of axis, and that its cross-section has roughly the same circular shape over the entire length in the direction of axis.

Additionally, the invention under the present application for patent is a method for manufacturing the aforementioned elastically deformable braided string, characterized in that, for the intermediate part, in a process to weave multiple yarns made of non-stretchable material, and multiple yarn-shaped rubber materials, in the direction of axis, areas of lower tensile moduli are formed by lifting them at high speed and weaving them loosely, while areas of higher tensile moduli are formed by lifting them at low speed and weaving them densely.

Effects of the Invention

According to the braided string under the present application for patent having the aforementioned constitution, the multiple areas having different tensile moduli formed in the intermediate part in the direction of axis allow the necessary tension to be applied to the necessary location when the string is set on a shoe or clothing, while the absence of knob parts like those employed by the prior art eliminates the need for cumbersome passing operations when setting the string or correcting its tension, and it furthermore makes the braided string look the same as any standard braided string and also clean and neat.

BRIEF DESCRIPTION OF THE DRAWINGS

FIG. 1 A drawing that schematically illustrates the braided string pertaining to the first embodiment of the present invention.

FIG. 2 A drawing showing the braided string pertaining to the first embodiment, being applied as a shoelace.

FIG. 3 A drawing showing the braided string pertaining to the first embodiment, being applied for a hat.

FIG. 4 A drawing that schematically illustrates the braided string pertaining to the second embodiment.

FIG. 5 A drawing that schematically illustrates the braided string pertaining to the third embodiment.

FIG. 6 A drawing showing the braided string pertaining to the third embodiment, being applied as a waist lanyard string.

FIG. 7 A drawing that schematically illustrates the braided string pertaining to a variation example of the third embodiment.

FIG. 8 A drawing showing the braided string pertaining to the variation example, being applied as a shoelace.

FIG. 9 A drawing that schematically illustrates the braided string pertaining to the fourth embodiment.

FIG. 10 A drawing that schematically illustrates an apparatus for manufacturing the braided string pertaining to the present invention, wherein (a) shows a weaving structure and (b) shows a weaving process.

FIG. 11 A drawing showing an example of use in which a traditional string having knob parts is applied for a shoe.

MODE FOR CARRYING OUT THE INVENTION

The respective embodiments of the present invention are explained in detail below using the drawings. It should be noted that the present invention is not limited to these embodiments in any way, and may be implemented in various modes to the extent that doing so does not deviate from the key points of the present invention.

FIG. 1 is a drawing that schematically illustrates the braided string pertaining to the first embodiment of the present invention. The braided string 1 is such that both of its left and right end areas represent firm areas X that undergo virtually no elastic deformation, and that two knob parts 2 are formed in each of these areas X. The knob parts 2 are members that function as stoppers against the insertion holes in a shoe, clothing, etc., on which the braided string 1 is set, and can deform elastically. For these knob parts 2, the knob parts described in Japanese Patent No. 3493002 may be referenced.

Also, depending on how the braided string 1 is used, the knob parts 2 may be firm and not elastically deforming. The reason for constituting the areas X at the end parts as firm and not elastically deforming is to facilitate the passing of the string through string openings or string holes. Also, the number of knob parts 2 is not limited to two, and may be one, three, or other greater number as deemed appropriate.

With the braided string 1, the intermediate part excluding the areas X at both the left and right ends are constituted by a combination of area A and area B having different tensile moduli, of which area B is placed at the center in a manner sandwiched by two areas A on the left and right. Area A is an area whose tensile modulus is lower than that of area B; that is, area A represents an area that can stretch more easily than area B in the lengthwise direction of axis under an external force applied from the left or right in the lengthwise direction of the axis of the braided string. The diameter of area A and that of area B is roughly the same so that area A and area B appear non-distinguishable to the naked eye. It should be noted that the term "tensile modulus" refers to a value obtained by dividing the tensile stress received by a material being stressed within the elastic limit, by the strain that generates in the material, and the greater (higher) this value, the smaller the deformation that the material will undergo at a constant load.

The braided string 1 having the aforementioned constitution is manufactured by the braided string manufacturing apparatus schematically illustrated in FIG. 10, for example. The braided string 1 is woven from a core material 4 constituted by five thin nylon material yarns at the center (see (b) in FIG. 10), around which 16 nylon yarns 5, each constituted by six fibers and fed from one of 16 bobbins are woven together with 8 rubber yarns 6 fed from between the bobbins (see (a) in FIG. 10). It should be noted that the number of bobbins from which the nylon yarns 5 are fed, and the number of rubber yarns 6, are merely examples representing an embodiment, and these numbers may be adjusted as deemed appropriate according to the size and length of the braided string 1, required elastic force, etc., to suit each purpose.

The bobbins are placed on the circumference drawn from the core material 4 defining the center, and the braided string 1 is formed by the circular motions of the bobbins rotating in the clockwise direction and counterclockwise direction, wherein the speed of lifting the core material 4, and the weaving time, are adjusted as deemed appropriate so as to form areas having different tensile moduli. It should be noted that, while the braided string is produced with the bobbins rotating at a constant speed in this embodiment, it can also be produced by adjusting the rotating speed of each bobbin.

Although the core material 4 is one that has virtually no stretching property in the length direction, adjusting the lifting speed of the core material 4 creates some allowance in the length direction, so that areas having varying tensile moduli from high to low can be created through the actions of the rubber yarns 6 surrounding the core material 4.

Table 1 lists the tensile test results showing the difference in tensile modulus between area A and area B. As shown, when one end of the braided string 1 was fixed to a fixing jig and a plumb weighing 1 kg was attached to the other end and let hang naturally, area A stretched from its natural-state length of 5 cm to 7.2 cm, while area B stretched from its natural-state length of 5 cm to 6.5 cm.

TABLE 1

| Area | Base length (cm) | Length when pulled (cm) | Rate of stretch (%) |
|---|---|---|---|
| X | 5 | 5 | 0 |
| B | 5 | 6.5 | 30 |
| A | 5 | 7.2 | 44 |

The braided string 1 in the first embodiment is used primarily as a shoelace, around the opening of a hat, or around the opening of a hood of a garment. FIG. 2 shows an example of applying the braided string 1 pertaining to the first embodiment as a shoelace for a shoe 7.

In general, this type of shoelace should be tightened so that more elastic force is exerted on the instep side, than the front side, of the foot for greater comfort and prevention of pain. Accordingly, the shoelace is set in such a way that the part corresponding to area B having a higher tensile modulus is placed on the front side of the shoe, while the parts corresponding to area A having a lower tensile modulus are placed on the instep side of the foot. Once the braided string 1 is set in an appropriate condition by the user, it is regulated in position by the knob parts 2 at the last string holes 8 and will not shift or come off during normal exercise. It should be noted that the knob parts 2 may be placed in a greater number as deemed appropriate, instead of two, on the left and right, so that the user can make finer position adjustments (tension adjustments).

It should be noted that some users may find it more comfortable to wear the shoe when the instep side of the foot is tightened firmly and the front side is tightened with an elastic force, which is the opposite of the above. In such cases, the positions of areas should be swapped, with area A in FIG. 1 changed to area B, and area B, to area A.

FIG. 3 shows the braided string 1 pertaining to the first embodiment, being applied around the opening of a hat 9. The hat 9 shown here is a hat 9 whose opening can be enlarged or reduced at its opening end parts 10 according to the size of the user's head. The braided string 1 is passed all around inside a hat string channel 11 formed around the opening, with the string set in such a way that the part of area B with a higher tensile modulus is placed on the brim side of the hat 9, while areas A with a lower tensile modulus are placed on the lateral sides of the hat 9.

According to the aforementioned constitution, the user can elastically fit the hat 9 to the size of his/her own head. To be specific, areas A apply smaller tensile forces to the temporal parts of the user's head to reduce any tightness or pressure the user might otherwise feel, while the placement of area B having a higher tensile modulus on the brim side of the hat makes it easy to maintain the shape of the brim part. Also, by setting appropriate knob parts 2 as stoppers at the end parts of the hat string channel 11 in the rear part of the hat 9, the braided string 1 can be set and maintained in a condition that makes it easy for the user to wear the hat.

Also, when the braided string is adopted around the opening of a hood of a garment, setting it so that area B with a higher tensile modulus is placed on the top side of the hood, while areas A with a lower tensile modulus are placed on the lateral sides of the hood, reduces any tightness or pressure the user might otherwise feel, while at the same time the placement of area B on the top part of the opening of the hood makes it easy to maintain the external shape of the hood (not illustrated).

FIG. 4 is a drawing that schematically illustrates the braided string 1 pertaining to the second embodiment of the present invention. The intermediate part of the braided string 1 pertaining to this embodiment is constituted by three types of areas including area A, area B, and area C that have different tensile moduli, wherein these areas are placed repeatedly in a sequence of area A→area B→area C→area B→area A→area B→area C→area B→area A, and so on.

The method for manufacturing the braided string 1 in the second embodiment is the same as that in the first embodiment, and is therefore not explained.

Table 2 lists the tensile test results showing the difference in tensile modulus among area A, area B, and area C. As shown, when one end of the braided string 1 was fixed to a fixing jig and a plumb weighing 1 kg was attached to the other end and let hang naturally, area A stretched from its natural-state length of 5 cm to 7.2 cm, area B stretched from its natural-state length of 5 cm to 6.5 cm, and area C stretched from its natural-state length of 5 cm to 5.7 cm.

TABLE 2

| Area | Base length (cm) | Length when pulled (cm) | Rate of stretch (%) |
|---|---|---|---|
| X | 5 | 5 | 0 |
| C | 5 | 5.7 | 14 |
| B | 5 | 6.5 | 30 |
| A | 5 | 7.2 | 44 |

The braided string 1 pertaining to the second embodiment having the aforementioned constitution is used primarily as a shoelace. To be specific, areas C having the highest tensile modulus are positioned near the string holes formed in the shoe, while area A and area B whose tensile moduli are lower than that of area C are positioned between the string holes, and because the parts contacting the instep of the user's foot are tightened with an appropriate elastic force, good wearing comfort can be maintained and the feeling of user can be improved further beyond the level achieved in the first embodiment (condition of the string in use is not illustrated).

FIG. 5 is a drawing that schematically illustrates the braided string 1 pertaining to the third embodiment of the present invention. The braided string 1 pertaining to this embodiment is such that the intermediate part of the braided string 1 is constituted by three areas of area A, area B, and area C having gradually increasing tensile moduli from one end toward the other end.

The method for manufacturing the braided string 1 in the third embodiment is also the same as that in the first or second embodiment, and is therefore not explained. Also, the tensile moduli of area A, area B, and area C are the same as those in the aforementioned second embodiment (refer to Table 2).

The braided string 1 pertaining to the third embodiment having the aforementioned constitution is used primarily as a waist lanyard string that the user hangs from his/her waist. FIG. 6 shows a state where a tool 12 used by a field worker is attached at a free end of the braided string 1. According to a normal method of use, area C with a higher tensile modulus is located on the waist side of the user, while area A with a lower tensile modulus is located on the tool side, so that the string, constituted to stretch more in areas closer to the end side, achieves greater ease of handling of the tool 12, and it also delivers greater comfort of use than a standard tool suspension string because, when the tool 12 is released, any direct transmission of the recovery force of the string to the user is reduced.

When the braided string 1 pertaining to the third embodiment is used as a waist lanyard string used by a worker to suspend tools, the knob parts 2 do not function as stoppers against the openings or holes, but they function, instead, to prevent knots made around a belt or tool from coming loose. It should be noted that, in the third embodiment, setting the tensile elasticities in area C and area B representing areas closer to the user as high as the level in area X may improve the feeling of use for some users; in such cases, the string may be constituted so that it has virtually no stretching property other than in area A.

FIG. 7 shows a variation example of the third embodiment, where the braided string 1 is constituted by two areas—area A having a lower tensile modulus and area B having a higher tensile modulus—placed side by side in the direction of axis. When the braided string 1 of this pattern is used as a shoelace, such shoelace can be passed spirally through the string holes 8 in the shoe 7 from the front end to the rear end in one pass, as shown in FIG. 8, to tighten the front side and instep side of the shoe to two different levels of tension.

FIG. 9 is a drawing showing the braided string 1 pertaining to the fourth embodiment of the present invention. The fourth embodiment is a different variation example of the first embodiment where area A with a lower tensile modulus has larger external dimensions than area B with a higher tensile modulus, and the respective areas are different enough to permit visual identification, while area A and area B are connected by link parts 3 that do not deform elastically.

According to the aforementioned constitution, the user can visually recognize the areas of different tensile moduli, which facilitates position adjustments when setting the string on a shoe, etc. Also, linking area A and area B with link parts 3 that do not deform elastically prevents the entire braided string 1 from overstretching through repeated use and eventually losing the desired elastic forces.

It goes without saying that the variation example presented in the aforementioned fourth embodiment can be applied correspondingly to the embodiments shown in FIG. 4, FIG. 5, and FIG. 7.

It should be noted that, while the intermediate part has three constituents of "area A, area B, and area A" in the first embodiment, it may have more constituents arranged in a repeated sequence of "area A, area B, area A, area B, area A, and so on," just like in the second embodiment, according to the purpose of use. Also, in the second embodiment and third embodiment, there may be not three types, but more types, such as four types and five types, of areas having different tensile moduli.

Additionally, while the knob parts 2 are formed on both the left and right ends of the braided string 1 in each of the aforementioned embodiments, the braided string 1 may be used with its one end side sewn and thus fixed to one's clothing, etc., in which case the knob parts 2 that function as stoppers only need to be formed either on the left end or right end.

Furthermore, while the core material 4 is placed at the center of the braided string 1 in the examples shown, the core material 4 is not necessarily required and a hollow constitution without core material 4 may also be adopted.

DESCRIPTION OF THE SYMBOLS

1 Braided string
2 Knob part
3 Link part
4 Core material
5 Nylon yarn
6 Rubber yarn
7 Shoe
8 Shoelace string hole
9 Hat
10 Hat opening end part
11 Hat string channel
12 Tool

What is claimed is:

1. An elastically deformable braided string whose intermediate part excluding both end areas can deform elastically in a direction of axis under an external pulling force, the elastically deformable braided string characterized in that:

the intermediate part consists of a single braid constituted by multiple yarns continuously interwoven in the direction of axis, and is divided into and constituted by multiple areas having different tensile moduli in the direction of axis; and the intermediate part has a cross-section roughly a same circular shape over an entire length in the direction of axis under no external pulling force, wherein the braided string is one woven, in the direction of axis, from the multiple yarns constituted by multiple non-stretchable yarns and multiple stretchable yarns of rubber material.

2. The elastically deformable braided string according to claim 1, characterized in that the intermediate part is constituted by two types of areas having different tensile moduli that are placed alternately along the direction of axis.

3. The elastically deformable braided string according to claim 1, characterized in that the braided string has one or multiple knob parts that are elastically deformable or not elastically deforming, in at least one of the both end areas.

4. The elastically deformable braided string according to claim 1, characterized in that the braided string has no core material placed at its cross-section center position over the entire length in the direction of axis.

5. The elastically deformable braided string according to claim 1, characterized in that the intermediate part is obtained in a process to interweave multiple non-stretchable yarns and multiple stretchable yarns of rubber material, continuously in the direction of axis, and the multiple areas of the intermediate part are constituted by areas of lower tensile moduli and areas of higher tensile moduli, wherein the areas of lower tensile moduli are formed by pulling the multiple non-stretchable yarns and the multiple stretchable yarns at high speed into a weaving device to interweave them loosely, while the areas of higher tensile moduli are formed by pulling the multiple non-stretchable yarns and the multiple stretchable yarns at low speed into the weaving device to interweave them densely.

6. The elastically deformable braided string according to claim 1, characterized in that the intermediate part is constituted by three types of areas having different tensile moduli that are placed repeatedly along the direction of axis in a sequence of high tensile modulus, medium tensile modulus, low tensile modulus, medium tensile modulus, high tensile modulus, medium tensile modulus, low tensile modulus, and so on.

7. The elastically deformable braided string according to claim 1, characterized in that the intermediate part has one end part and an other end part, and the multiple areas thereof are placed in sequence in a manner to have gradually decreasing tensile moduli from the one end part toward the other end part along the direction of axis.

8. An elastically deformable braided string whose intermediate part excluding both end areas can deform elastically in a direction of axis under an external pulling force, wherein the intermediate part is divided into and constituted by multiple areas having different tensile moduli in the direction of axis; and the intermediate part has a cross-section roughly a same circular shape over an entire length in the direction of axis, said elastically deformable braided string being characterized in that, in the intermediate part, the multiple areas of different tensile moduli are formed by linking every adjoining two areas of the multiple areas via a link part that does not deform elastically.

9. The elastically deformable braided string according to claim 8, characterized in that the intermediate part is constituted by three types of areas having different tensile moduli that are placed repeatedly along the direction of axis in a sequence of high tensile modulus, medium tensile modulus, low tensile modulus, medium tensile modulus, high tensile modulus, medium tensile modulus, low tensile modulus, and so on.

10. The elastically deformable braided string according to claim 8, characterized in that the intermediate part has one end part and an other end part, and the multiple areas thereof are placed in sequence in a manner to have gradually decreasing tensile moduli from the one end part toward the other end part along the direction of axis.

11. The elastically deformable braided string according to claim 8, characterized in that the braided string has one or multiple knob parts that are elastically deformable or not elastically deforming, in at least one of the end areas.

12. The elastically deformable braided string according to claim 8, characterized in that the braided string has no core material placed at its cross-section center position over the entire length in the direction of axis.

13. The elastically deformable braided string according to claim 8, characterized in that the intermediate part is obtained in a process to interweave multiple non-stretchable yarns and multiple stretchable yarns of rubber material, continuously in the direction of axis, and the multiple areas of the intermediate part are constituted by areas of lower tensile moduli and areas of higher tensile moduli, wherein the areas of lower tensile moduli are formed by pulling the multiple non-stretchable yarns and the multiple stretchable yarns at high speed into a weaving device to interweave them loosely, while the areas of higher tensile moduli are formed by pulling the multiple non-stretchable yarns and the multiple stretchable yarns at low speed into the weaving device to interweave them densely.

14. The elastically deformable braided string according to claim 8, wherein the intermediate part is constituted by two types of areas having different tensile moduli that are placed alternately along the direction of axis.

15. The elastically deformable braided string according to claim 14, characterized in that the braided string has one or multiple knob parts that are elastically deformable or not elastically deforming, in at least one of the both end areas.

16. The elastically deformable braided string according to claim 14, characterized in that the braided string has no core material placed at its cross-section center position over the entire length in the direction of axis.

17. The elastically deformable braided string according to claim 14, characterized in that the intermediate part is obtained in a process to interweave multiple non-stretchable yarns and multiple stretchable yarns of rubber material, continuously in the direction of axis, and the multiple areas of the intermediate part are constituted by areas of lower tensile moduli and areas of higher tensile moduli, wherein the areas of lower tensile moduli are formed by pulling the multiple non-stretchable yarns and the multiple stretchable yarns at high speed into a weaving device to interweave them loosely, while the areas of higher tensile moduli are formed by pulling the multiple non-stretchable yarns and the multiple stretchable yarns at low speed into the weaving device to interweave them densely.

18. The elastically deformable braided string according to claim 8, characterized in that the braided string is one interwoven, in the direction of axis, from multiple non-stretchable yarns and multiple stretchable yarns of rubber material.

19. A method for manufacturing an elastically deformable braided string whose intermediate part excluding both end areas can deform elastically in a direction of axis under an external pulling force, the elastically deformable braided string characterized in that:

the intermediate part consists of a single braid constituted by multiple yarns continuously interwoven in the direction of axis, and is divided into and constituted by multiple areas having different tensile moduli in the direction of axis; and the intermediate part has a cross-section roughly a same circular shape over an entire length in the direction of axis under no external pulling force, the method for manufacturing elastically deformable braided string characterized in that, for the intermediate part, in a process to interweave multiple non-stretchable yarns and multiple stretchable yarns of rubber material, continuously in the direction of axis, areas of lower tensile moduli are formed by pulling the multiple non-stretchable yarns and the multiple stretchable yarns at high speed into a weaving device to interweave them loosely, while areas of higher tensile moduli are formed by pulling the multiple non-stretchable yarns and the multiple stretchable yarns at low speed into the weaving device to interweave them densely.

* * * * *